US012072126B2

(12) United States Patent
Katikala et al.

(10) Patent No.: US 12,072,126 B2
(45) Date of Patent: Aug. 27, 2024

(54) SYSTEM AND METHOD FOR CONTROLLING A FLOW OF REFRIGERANT IN A REVERSING VALVE

(71) Applicant: Carrier Corporation, Palm Beach Gardens, FL (US)

(72) Inventors: Lok Sudhir Katikala, Telangana (IN); Ashoka ThimmaReddy, Telangana (IN); Ashalatha Kapa, Telangana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 310 days.

(21) Appl. No.: 17/718,829

(22) Filed: Apr. 12, 2022

(65) Prior Publication Data

US 2022/0333835 A1 Oct. 20, 2022

(30) Foreign Application Priority Data

Apr. 16, 2021 (IN) ..... 202111017714

(51) Int. Cl.
*F25B 41/26* (2021.01)
*F25B 13/00* (2006.01)
*F25B 49/02* (2006.01)

(52) U.S. Cl.
CPC ..... *F25B 41/26* (2021.01); *F25B 13/00* (2013.01); *F25B 49/02* (2013.01); *F25B 2313/027* (2013.01); *F25B 2400/06* (2013.01)

(58) Field of Classification Search
CPC .... F25B 13/00; F25B 2313/027; F25B 49/02; F25B 41/26; F25B 2400/06; F25B 2400/075
See application file for complete search history.

(56) References Cited

U.S. PATENT DOCUMENTS 4,178,768 A * 12/1979 Pauliukonis ..... F25B 41/26 62/160
4,237,933 A * 12/1980 Bauer ..... F16K 27/041 137/625.29
4,381,798 A * 5/1983 Tobin ..... F25B 41/26 137/625.43
4,526,201 A * 7/1985 Geyler, Jr. ..... F15B 13/0403 251/285
2006/0242987 A1* 11/2006 Zhu ..... F25B 41/26 62/352
2015/0354713 A1* 12/2015 Hancock ..... F16K 11/065 62/77
2017/0273792 A1* 9/2017 Evans ..... A61F 2/26
2018/0299173 A1* 10/2018 Huang ..... F25B 41/26
2019/0226726 A1* 7/2019 Tolouee ..... F25B 29/003

* cited by examiner

*Primary Examiner* — Henry T Crenshaw
(74) *Attorney, Agent, or Firm* — CANTOR COLBURN LLP

(57) ABSTRACT

A system and method for dual compressor modulation by controlling a flow of refrigerant in a reversing valve. A method includes receiving, by a control board, a command for operating a reversing valve in different modes. The reversing valve includes a first tube, a second tube, a third tube, a fourth tube and a fifth tube. The method includes determining a position for operating the reversing valve in a first position or a second position in a first mode and in a third position or a fourth position in a second mode. The method includes controlling a flow of refrigerant based on the command and the position by connecting the fourth tube with a first compressor in the first/third position and connecting the fifth tube with a second compressor in the second/fourth position.

22 Claims, 10 Drawing Sheets

Section AA

Section BB

Section CC

Section DD

SYSTEM AND METHOD FOR CONTROLLING A FLOW OF REFRIGERANT IN A REVERSING VALVE

FOREIGN PRIORITY

This application claims priority to Indian Patent Application No. 202111017714, filed Apr. 16, 2021, and all the benefits accruing therefrom under 35 U.S.C. § 119, the contents of which in its entirety are herein incorporated by reference.

TECHNICAL FIELD OF INVENTION

The present invention generally relates to heating, ventilation, and air conditioning (HVAC) systems. More particularly, the invention relates to a system and a method for dual Compressor modulation through controlled flow of refrigerant in a reversing valve of the HVAC systems.

BACKGROUND OF THE INVENTION

Compressors in Heat Pumps have been sized with cooling/heating capacities sufficient for the greatest system load they will encounter. But because loads vary widely with the seasons, and even from hour to hour, the compressor sized for the maximum load turns out to be oversized for long periods Heat pumps are used for heating and/or cooling an area in a premises. The heat pumps provides heating operation, defrosting operation as well as cooling operation. A reversible valve is used in the heat pumps for performing heating, defrosting, and cooling operations.

However, in the existing heat pumps the energy consumption is not optimized and the heat pumps consume a significant portion of energy. Further, the new standards proposed by the government and to be effective in the coming years require a seasonal energy efficiency ratio (SEER). That is, higher the rating of SEER, more energy-efficient the heat pump is. Due to the demand in the improved SEER ratings, robust combination of regulatory requirements and customer preferences are driving original equipment manufacturers (OEMs) needs to achieve unprecedented levels of compressor energy efficiency without sacrificing reliability and comfort.

In view of the afore-mentioned problems in the heat pumps, the components of the heat pumps may be effectively designed. There is a need of an efficient and effective heat pump which has enhanced energy efficiency and also provides improved comfort and provide higher SEER ratings.

SUMMARY OF THE INVENTION

Various embodiments of the invention describe a system for operating dual Compressor modulations as per cooling & heating loads by controlling a flow of refrigerant in a reversing valve of an HVAC system. The system comprises of compressors, a reversing valve, a control board and a stepper motor. The reversing valve is adapted to operate in a first mode or a second mode. Also, the reversing valve comprises a first tube, a second tube, a third tube, a fourth tube, and a fifth tube. The control board is adapted to receive a command and determine a position for operating the reversing valve in the first mode or the second mode. Further, the reversing valve is operated in a first position or a second position in the first mode. Furthermore, the reversing valve is operated in a third position or a fourth position in the second mode. The stepper motor is adapted to control a flow of refrigerant based on the command and the position by connecting the fourth tube with a first compressor in the first position and the third position and connecting the fifth tube with a second compressor in the second position and the fourth position.

In an embodiment of the invention, the first compressor and the second compressor perform a dual compressor modulation adapted to operate in part load or a full load in the first or the second mode.

In another embodiment of the invention, the first compressor is a rotary compressor and the second compressor is a scroll compressor.

In yet another embodiment of the invention, the first mode corresponds to a cooling mode and the second mode corresponds to a heating mode.

In another embodiment of the invention, the first tube connects with the third tube and the second tube connects with the fourth tube when the reversing valve operates in the first position and in the first mode.

In still another embodiment of the invention, the first tube connects with the third tube and the second tube connects with the fifth tube when the reversing valve operates in the second position and in the first mode.

In a different embodiment of the invention, the first tube connects with the second tube and the third tube connects with the fourth tube when the reversing valve operates in the third position and in the second mode.

In yet another embodiment of the invention, the first tube connects with the second tube and the third tube connects with the fifth tube when the reversing valve operates in the fourth position and in the second mode.

In an embodiment of the invention, in the first position the refrigerant flows from the first compressor to the first tube, from the first tube to the third tube, from the third tube to an outdoor coil, from the outdoor coil to an indoor coil, from the indoor coil to the second tube, from the second tube to the fourth tube and from the fourth tube to the first compressor.

In yet another embodiment of the invention, in the second position the refrigerant flows from the second compressor to the first tube, from the first tube to the third tube, from the third tube to an outdoor coil, from the outdoor coil to an indoor coil, from the indoor coil to the second tube, from the second tube to the fifth tube and from the fifth tube to the second compressor.

In another embodiment of the invention, in the third position the refrigerant flows from the first compressor to the first tube, from the first tube to the second tube, from the second tube to an indoor coil, from the indoor coil to an outdoor coil, from the outdoor coil to the third tube, from the third tube to the fourth tube and from the fourth tube to the first compressor.

In yet another embodiment of the invention, in the fourth position the refrigerant flows from the second compressor to the first tube, from the first tube to the second tube, from the second tube to an indoor coil, from the indoor coil to an outdoor coil, from the outdoor coil to the third tube, from the third tube to the fifth tube and from the fifth tube to the second compressor.

In another embodiment of the invention, a piston is translated or/and rotated by the stepper motor, wherein the piston is coupled with the reversing valve to control the flow of refrigerant based on a required load.

In still another embodiment of the invention, the command is provided for operating the reversing valve based on an outside air temperature.

Various embodiments of the invention describe a method for controlling a flow of refrigerant in a reversing valve of an HVAC system using different compressors. The method comprises the step of receiving a command for operating the reversing valve in a first mode or a second mode. Also, the reversing valve comprises a first tube, a second tube, a third tube, a fourth tube, and a fifth tube. The method also comprises the steps of determining, by a control board, a position for operating the reversing valve in a first position or a second position in the first mode and in a third position or a fourth position in the second mode. The method also comprises the steps of controlling a flow of refrigerant using a stepper motor based on the command and the position by connecting the fourth tube with a first compressor in the first position and the third position and connecting the fifth tube with a second compressor in the second position and the fourth position.

In an embodiment of the invention, the first compressor and the second compressor perform a dual compressor modulation adapted to operate in part load or a full load in the first or the second mode.

In an embodiment of the invention, the first compressor and the second compressor are of different type, wherein the first compressor is a rotary compressor and the second compressor is a scroll compressor.

In another embodiment of the invention, the first mode corresponds to a cooling mode and the second mode corresponds to a heating mode.

In still another embodiment of the invention, the first tube connects with the third tube and the second tube connects with the fourth tube when the reversing valve operates in the first position and in the first mode.

In yet another embodiment of the invention, the first tube connects with the third tube and the second tube connects with the fifth tube when the reversing valve operates in the second position and in the first mode.

In an embodiment of the invention, the first tube connects with the second tube and the third tube connects with the fourth tube when the reversing valve operates in the third position and in the second mode.

In another embodiment of the invention, the first tube connects with the second tube and the third tube connects with the fifth tube when the reversing valve operates in the fourth position and in the second mode.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which taken in conjunction with the annexed drawings, discloses exemplary embodiments of the invention.

BRIEF DESCRIPTION OF THE DRAWINGS

Corresponding reference numerals indicate corresponding parts throughout the drawings.

DETAILED DESCRIPTION OF THE INVENTION

Figure 1A:
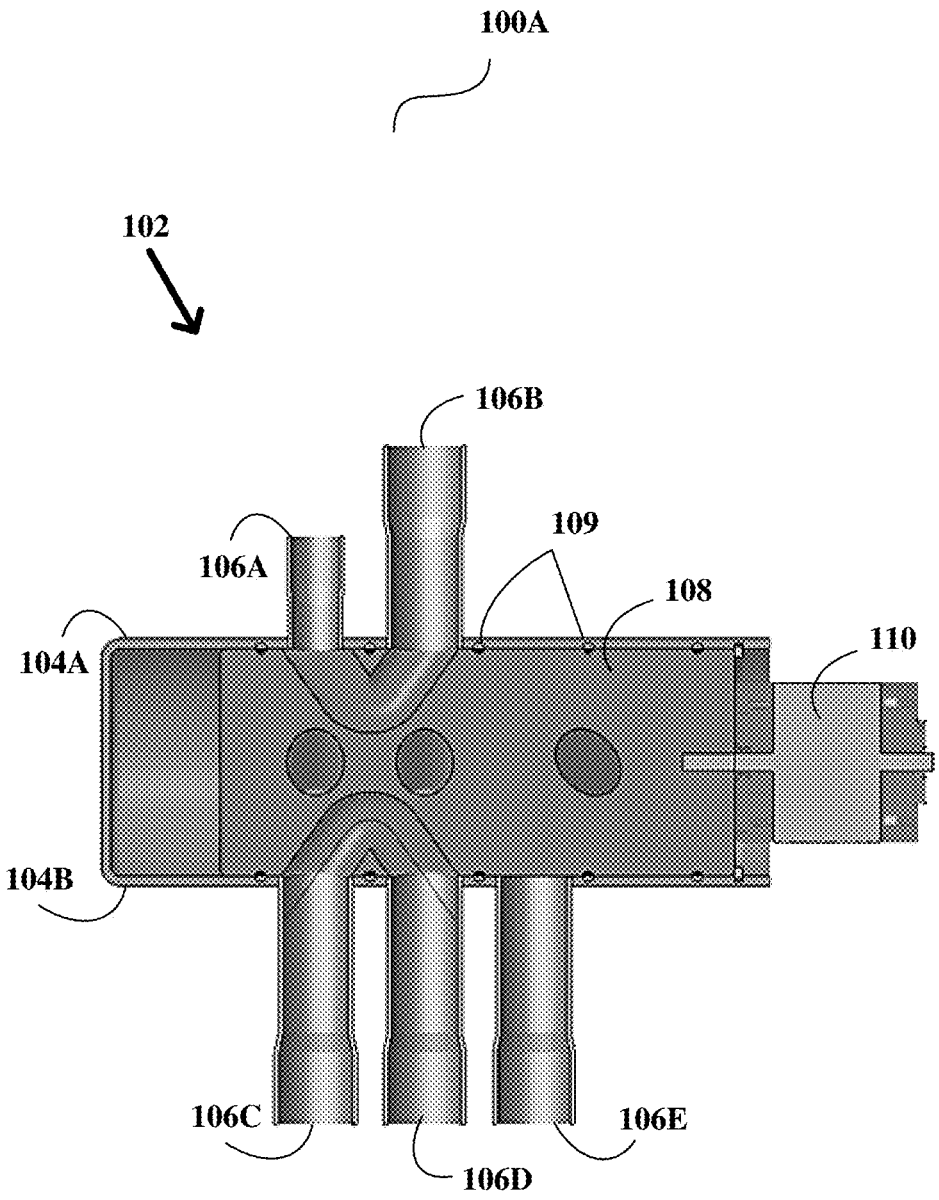
FIG. 1A depicts an external view of an exemplary reversing valve, according to an exemplary embodiment of the invention.

The present invention is directed towards operating dual compressors modulation as per cooling & heating loads. Dual compressors can operate individually or together, delivering several discrete capacity stages as needed while maintaining high Energy Efficiency Ratings (EER). The operation of the compressor is controlled by the flow of refrigerant in a reversing valve of the HVAC systems.

In order to provide an efficient and effective heat pump having enhanced energy efficiency with higher Energy Efficiency rating (EER) and offering improved comfort, a reversing valve which can be connected with different types of compressors (i.e. a first compressor and a second compressor) is described. In an exemplary embodiment, a rotary compressor or a scroll compressor may be connected to a tube of the reversing valve depending upon the cooling and heating requirements. The compressors may be operated individually or together, delivering several discrete capacity stages as needed while maintaining high EER. Use of multiple compressors offer improved part-load efficiencies, including Integrated Energy Efficiency Ratio (IEER) for rooftops. Such kind of arrangement may be used in packaged rooftop systems, split systems, or chillers to provide optimal load matching. The use of different compressors in same HVAC system at different loads may be termed as modulation of the compressors. This type of modulation enables original equipment manufacturers (OEMs) to boost system part-load efficiency levels, as well as the ability to meet new energy standards and regulations. The details of arrangement and working of two compressors with a reversing valve is explained below.

Described herein is the technology with a system and a method for controlling a flow of refrigerant in a reversing valve of an HVAC system using different types of compressors. The reversing valve may comprise a first tube, a second tube, a third tube, a fourth tube and a fifth tube. Further, the reversing valve may be connected with two different types of compressors (i.e. a first compressor and a second compressor), an indoor coil, an outdoor coil and an expansion through ends of these five tubes. Furthermore, the reversing valve may be operated in different modes and positions based on a command. Such command may be provided by a user through a thermostat or any handheld module for operating the reversing valve in one of a first mode or a second mode.

Moreover, the command may be received by a control board either through wired communication or wireless communication. The control board may accordingly determine an appropriate position for operating the reversing valve in the first mode or the second mode. In an exemplary embodiment, the reversing valve may be operated in a first position or in a second position in the first mode. In another exemplary embodiment, the reversing valve may be operated in a third position or a fourth position in the second mode.

Further, the control board may communicate the command and the determined position to a stepper motor. Then, the stepper motor may translate and/or rotate a piston of the reversing valve based on the command and the determined position to control the flow of refrigerant. In an exemplary embodiment, the fourth tube of the reversing valve may be connected with a first compressor in the first position and the third position. In another exemplary embodiment, the fifth tube may be connected with a second compressor in the second position and the fourth position. The connection of the tubes with two different compressors is explained below in detail.

As used herein, the reversing valve may operate a piston to control the flow of refrigerant through the reversing valve based on the different modes and function using the different compressors, i.e., the first compressor and the second compressor. The first mode may correspond to a cooling mode and the second mode may correspond to a heating mode. The details of flow of the refrigerant in the reversing valve operating in various modes have been explained in detail below. The reversing valve may be any reversing valve that is well known in the art.

As used herein, the control board may be an electronic circuitry or a printed circuit board communicably coupled and/or attached with the reversing valve and/or a thermostat. The control board may also be communicably coupled with the thermostat to receive a command. The command may be provided by a user to operate the HVAC system having the reversing valve in any of the modes described herein. The control board may further be communicably coupled and/or attached with a stepper motor. In an exemplary embodiment, the control board may comprise a processor coupled with a memory to perform the operations of controlling the reversing valve as described herein.

As used herein, the stepper motor may be communicably coupled with the reversing valve and/or the control board. The stepper motor may translate and/or rotate the piston of the reversing valve based on the command and the determined position received from the control board. The stepper motor may be any stepper motor that is well known in the art.

FIG. 1A depicts an exemplary view of an exemplary reversing valve according to an exemplary embodiment of the invention. As depicted, the view 100A of a reversing valve 102 in FIG. 1A, the reversing valve 102 may have a first side 104A and a second side 104B. On the first side 104A, the reversing valve 102 may comprise a first tube 106A and a second tube 106B. On the second side 104B, the reversing valve 102 may comprise a third tube 106C, a fourth tube 106D and a fifth tube 106E. Further, the reversing valve 102 also comprises stepper motor 110 present inside/outside a housing of the reversing valve 102. Also depicted is a piston 108 coupled with the reversing valve 102 to control the flow of refrigerant based on a required load as described below. The O-Rings 109 are used to seal the refrigerant leak and also helps for smooth transition as shown. The stepper motor 110 may translate and/or rotate the piston 108 to operate the reversing valve 102 in various positions based on modes as described below.

Figure 1B:
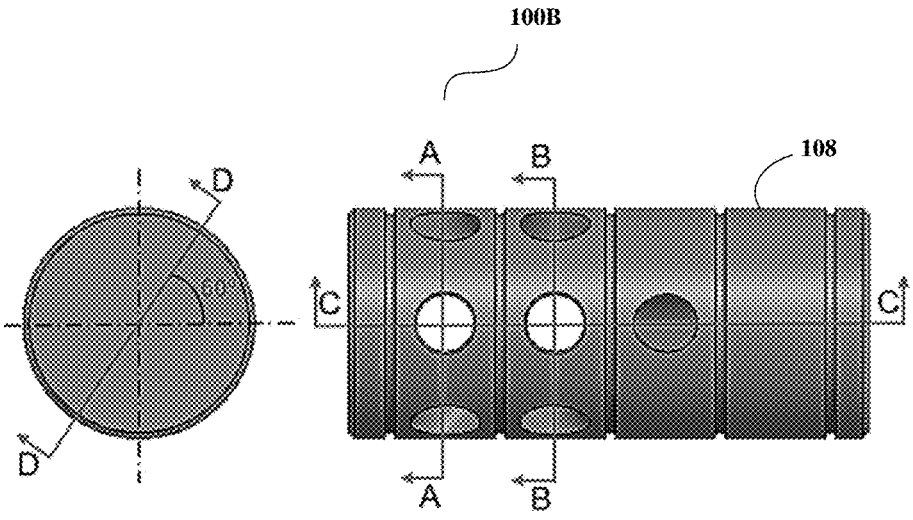
FIG. 1B depicts an exemplary piston of the exemplary reversing valve according to an exemplary embodiment of the invention.

FIG. 1B depicts an exemplary view 100B of an exemplary piston 108 of the exemplary reversing valve according to an exemplary embodiment of the invention. As can be seen, the piston 108 of the reversing valve 102 may comprise holes receiving the tubes 106A-106E to be fitted therein and to allow flow of the refrigerant within the tubes 106A-106E in various modes and positions.

Figure 1C:
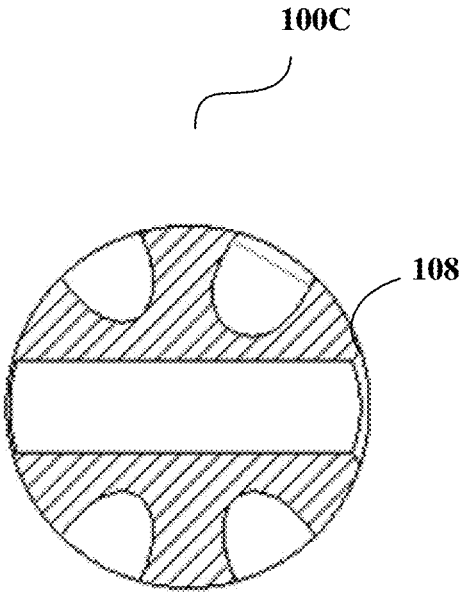
FIG. 1C-1F depict a cross-sectional view of an exemplary piston in different positions according to an exemplary embodiment of the invention.
Figure 1D:
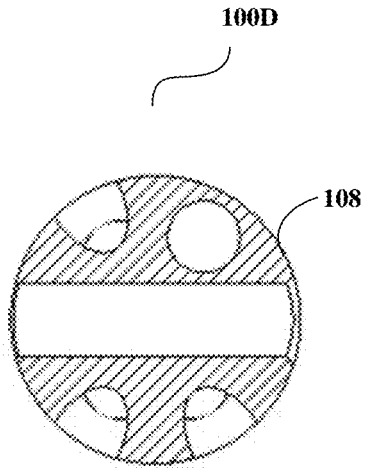
Figure 1E:
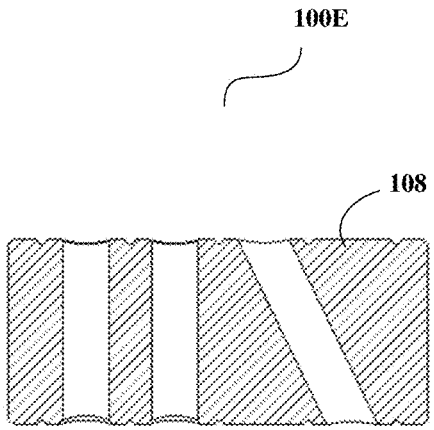
Figure 1F:
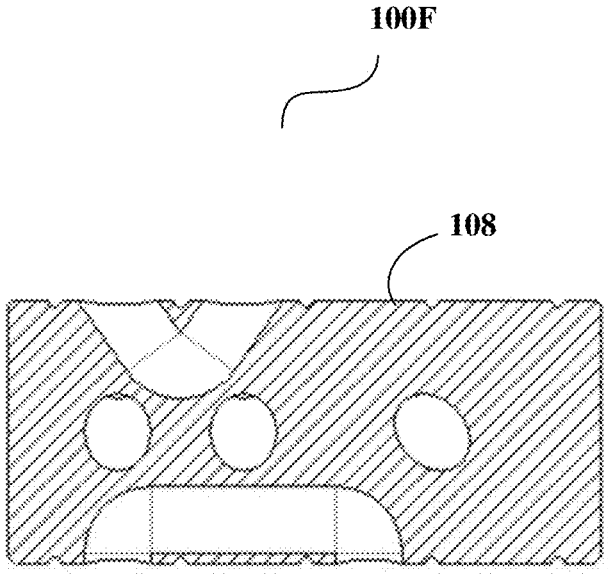

FIG. 1C depict a cross-sectional view 100C of an exemplary piston 108 and FIG. 1D depict a cross-sectional view 100D of an exemplary piston 108 according to an exemplary embodiment of the invention. Further, FIG. 1E depict a cross-sectional view 100E of an exemplary piston 108 and FIG. 1F depict a cross-sectional view 100F of an exemplary piston 108 according to an exemplary embodiment of the invention.

Figure 2A:
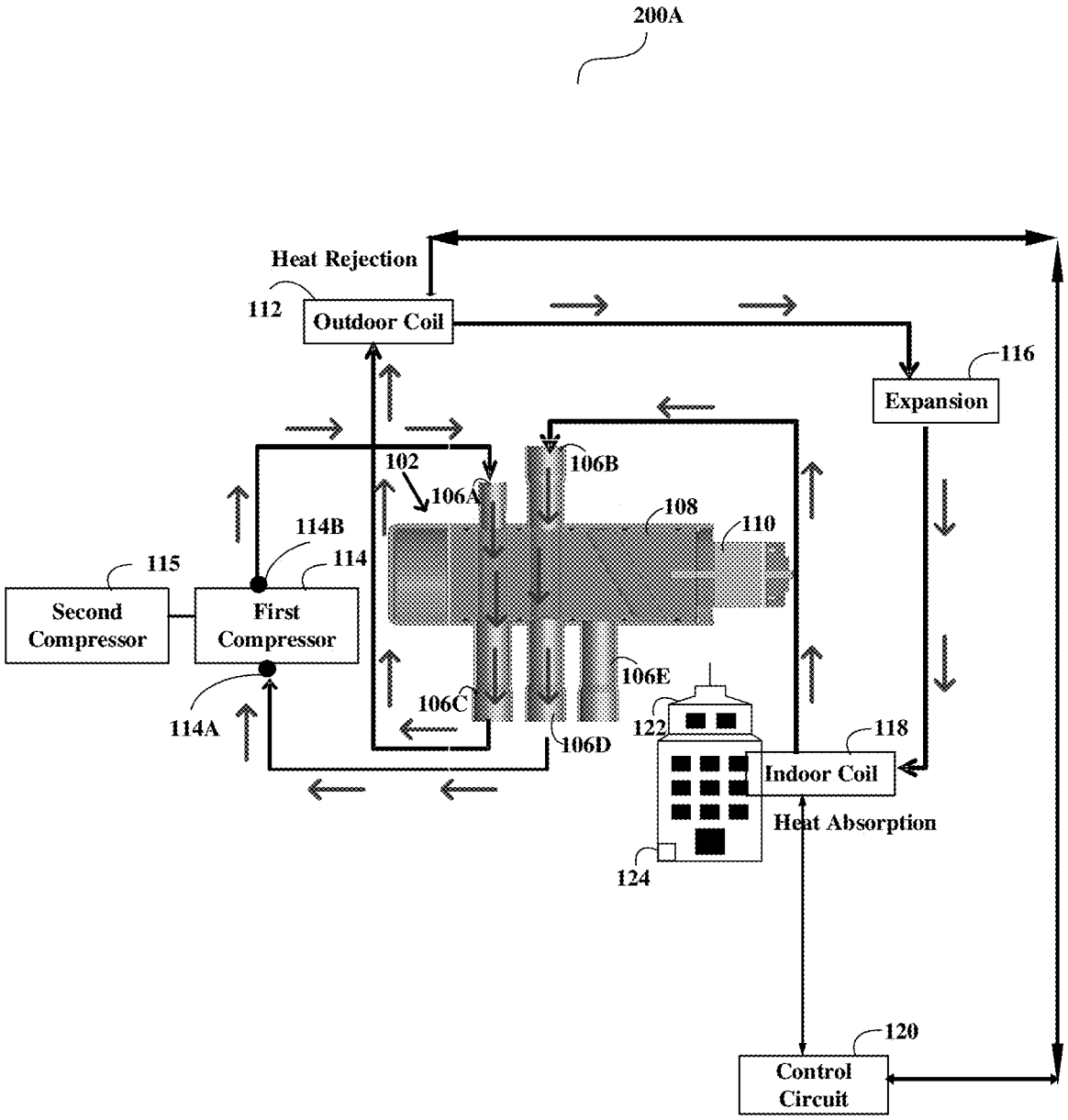
FIG. 2A depicts an exemplary reversing valve operating in a first position in a first mode according to an exemplary embodiment of the invention.

FIG. 2A depicts an exemplary reversing valve 102 operating in a first position in a first mode according to an exemplary embodiment of the invention. A user (not shown) may select an option in a thermostat 124 (installed in a home 122) to operate the HVAC system in the first mode i.e. cooling mode. For this, the user may use a soft button or hard button provided on an interface of the thermostat 124 to give a command for operating the HVAC system. In particular, the HVAC system operates the reversing valve 102 in the first mode. Alternatively, the user may provide a command through an application of the thermostat 124 stored in a device such as a mobile device or a remote control device. Before the user provides the command, a heat pump of the reversing valve 102 may be powered-on to start functioning. At this stage, the reversing valve 102 may be already operating in a heating mode and thus, the user may provide a command for mode reversal. In a different exemplary embodiment, the user may set temperature in the thermostat 124 and based on the set temperature, the system 200A may automatically decide the mode of the reversing valve 102. In specific, the user may set the temperature based on number of people/occupants present in the building/home 122. Alternatively, the temperature may be automatically set by the control board on detecting ambient temperature and the number of occupants in a given area.

When the user selects the option to operate the reversing valve 102 in the first mode, the thermostat 124 may transmit a command to a control board 120 through a wired network or a wireless network. The control board 120 may be communicably coupled or connected with the thermostat 124 and/or the reversing valve 102. The control board 120 may be present inside or outside the building/home 122. The control board 120 may be implemented using a microprocessor-based device, executing instructions to perform the operations described herein.

When the control board 120 receives the command from the thermostat 124 to operate the reversing valve 102, the control board 120 may determine an appropriate position for operating the reversing valve 102 to control the flow of refrigerant in the reversing valve 102. For this, the appropriate position is determined by the control board 120 based on air temperature outside the building/home 122. In an exemplary embodiment, the position may correspond to a first position in the first mode. In an exemplary embodiment, the control board 120 may request the thermostat 124 to provide a current air temperature outside the building/home 122. In another exemplary embodiment, the control board 120 may be itself capable of determining the current air temperature outside the building/home 122.

After the control board 120 determines or receives the current air temperature outside the building/home 122, the control board 120 may accordingly determine the appropriate position for controlling the flow of refrigerant in the reversing valve 102. The control board 120 may determine a first position for the first mode, for e.g. a cooling mode. The control board 120 may determine the first position when the current air temperature outside the building/home 122 varies between a first temperature threshold and a second temperature threshold. In an exemplary embodiment, the first temperature threshold may be 65° Fahrenheit and the second temperature threshold may be 85° Fahrenheit. When the current air temperature outside the building/home 122 varies between the first temperature threshold and the second temperature threshold, the control board 120 may determine the first position for the first mode (cooling mode). In an exemplary embodiment, the first position of the reversing valve 102 may refer to a position when the reversing valve 102 operates at partial load (i.e. 1 ton to 2.5 tons).

Then, the control board 120 may communicate the command and the determined first position to the stepper motor 110 for operating the reversing valve 102 in the first mode. When the stepper motor 110 receives the command and the determined first position, the stepper motor 110 may translate and/or rotate the piston 108 based on the command and the determined first position. In particular, the stepper motor 110 may translate and/or rotate the piston 108 to the first position when the piston 108 is at any other position. That is, using the command and the determined position the control board would evaluate the position of the stepper motor and rotate the stepper motor accordingly. In case, the piston 108 is already positioned at the first position, then the stepper motor 110 does not rotate and/or translate the piston 108.

Furthermore, as depicted in FIG. 2A, the first tube 106A may be connected to a discharge/outlet port of a first compressor 114B. The second tube 106B may be connected to an indoor coil 118 and the third tube 106C may be connected to an outdoor coil 112. And, the fourth tube 106D may be connected to a return/inlet port of the first compressor 114 and the fifth tube 106E is not connected to any components as shown. In an exemplary embodiment, the indoor coil 118 may be adapted to absorb the heat inside the building/home 122 and the outdoor coil 112 may be adapted to reject the heat outside the building/home 122.

Moreover, as depicted in FIG. 2A, in the first position and in the first mode of the reversing valve 102, the refrigerant may flow from the discharge/outlet port 114B of the first compressor 114 to the first tube 106A and from the first tube 106A to the third tube 106C. Then, from the third tube 106C to the outdoor coil 112, from the outdoor coil 112 to the indoor coil 118 through an expansion 116, and from the indoor coil 118 to the second tube 106B. From the second tube 106B to the fourth tube 106D, from the fourth tube 106D to the return/inlet port 114A of the first compressor 114 in the first mode. Thus, the first tube 106A connects with the third tube 106C and the second tube 106B connects with the fourth tube 106D when the reversing valve 102 operates in the first position and in the first mode.

Thereby, in the first position and in the first mode, the first compressor 114 (i.e. rotary compressor) is only utilized for cooling requirements at partial load (i.e. 1 ton to 2.5 tons). Furthermore, the second compressor 115 is not at all utilized for the cooling requirements. Using only the first compressor 114 (i.e. rotary compressor) for the cooling requirements and not the second compressor 115 would eventually save the energy needed to operate the system in cooling mode (first mode) at the partial load.

Figure 2B:
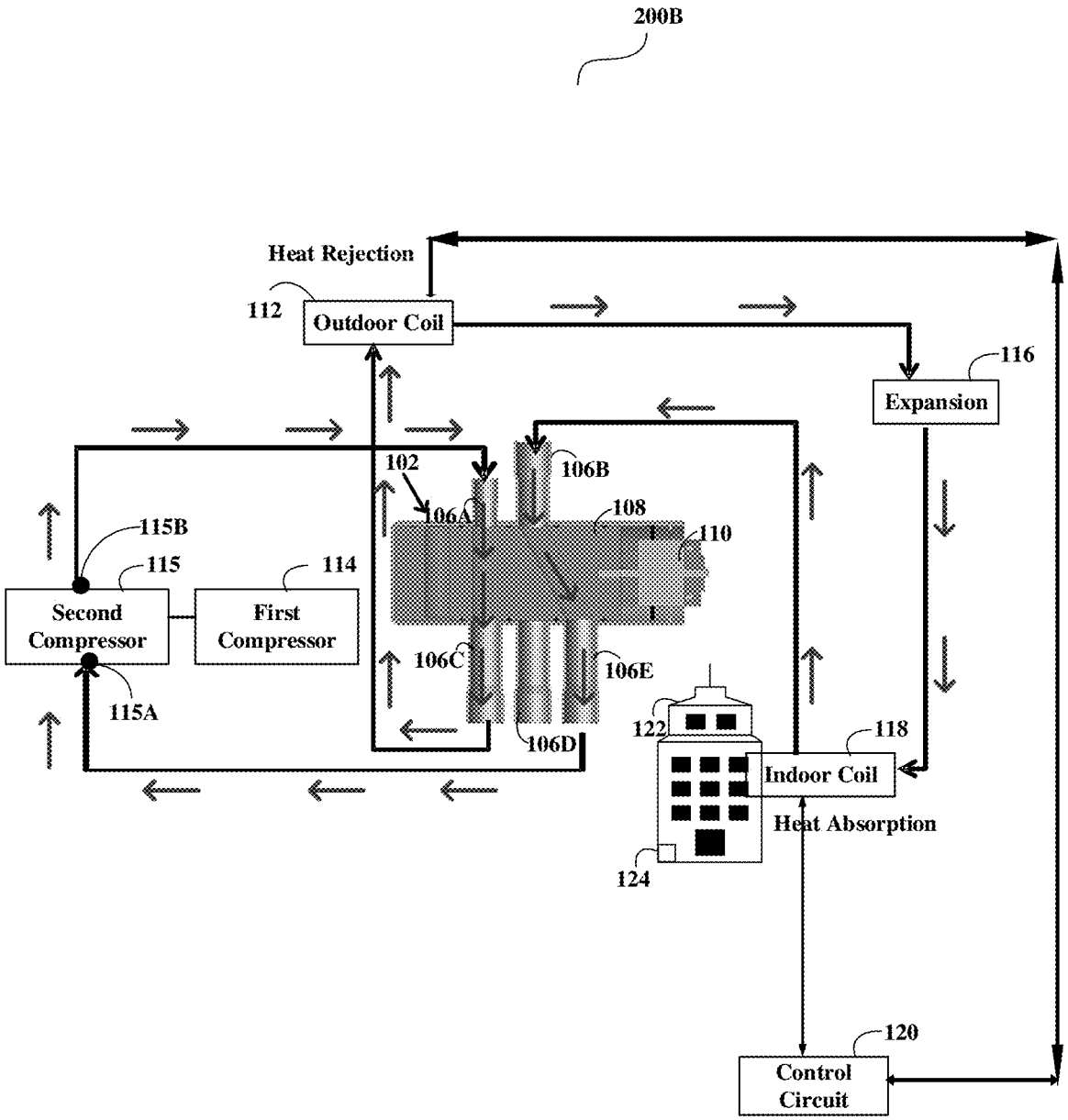
FIG. 2B depicts an exemplary reversing valve operating in a second position in a first mode according to an exemplary embodiment of the invention.

FIG. 2B depicts an exemplary reversing valve operating in a second position in a first mode according to an exemplary embodiment of the invention. As explained above in FIG. 2A, a user may select an option in a thermostat 124 to operate the reversing valve 102 in the first mode i.e. cooling mode. When the user selects the option to operate the reversing valve 102 in the first mode, the thermostat 124 may transmit a command to a control board 120.

When the control board 120 receives the command from the thermostat 124 to operate the reversing valve 102, the control board 120 may determine an appropriate position for operating the reversing valve 102 to control the flow of refrigerant in the reversing valve 102. For this, the appropriate position is determined by the control board 120 based on air temperature outside the building/home 122 as explained in FIG. 2A above. In an exemplary embodiment, the position may correspond to a second position in the first mode/cooling mode.

The control board 120 may determine the second position when the current air temperature outside the building/home 122 varies between the second temperature threshold and a third temperature threshold and above. In an exemplary embodiment, the second temperature threshold may be 85° Fahrenheit and the third temperature threshold may be 105° Fahrenheit and above. When the current air temperature outside the building/home 122 varies between the second temperature threshold and the third temperature threshold, the control board 120 may determine the second position for the first mode. In an exemplary embodiment, the second position of the reversing valve 102 may refer to a position when the reversing valve 102 operates at full load (i.e. 3 tons to 5 tons).

Then, the control board 120 may communicate the command and the determined second position to the stepper motor 110 for operating the reversing valve 102 in the first mode as per the command and the determined second position. The stepper motor 110 may translate and/or rotate the piston 108 based on the received command and the determined second position. As shown in FIG. 2B and in comparison, with FIG. 2A, the stepper motor 110 has moved the piston 108 in an outward linear direction (from right to left direction) to the second position for changing from the first position to the determined second position.

Furthermore, as depicted in FIG. 2B, the first tube 106A may be connected to a discharge/outlet port (not shown) of a second compressor 115. The second tube 106B may be connected to an indoor coil 118 and the third tube 106C may be connected to an outdoor coil 112. And, the fifth tube 106E may be connected to a return/inlet port 115A of the second compressor 115 and the fourth tube 106D is not connected to any components as shown.

Moreover, as depicted in FIG. 2B in the second position and in the first mode of the reversing valve 102, the refrigerant may flow from the discharge/outlet port 115B of the second compressor 115 to the first tube 106A and from the first tube 106A to the third tube 106C. Then, from the third tube 106C to the outdoor coil 112, from the outdoor coil 112 to the indoor coil 118 through an expansion 116, and from the indoor coil 118 to the second tube 106B. From the second tube 106B to the fifth tube 106E, from the fifth tube 106E to the return/inlet port 115A of the second compressor 115 in the second position. Thus, the first tube 106A connects with the third tube 106C and the second tube 106B connects with the fifth tube 106E when the reversing valve 102 operates in the second position and in the first mode. In this embodiment, the second compressor 115 (i.e. scroll compressor) is utilized to provide cooling requirements at full load (i.e. 3 tons to 5 tons).

Figure 3A:
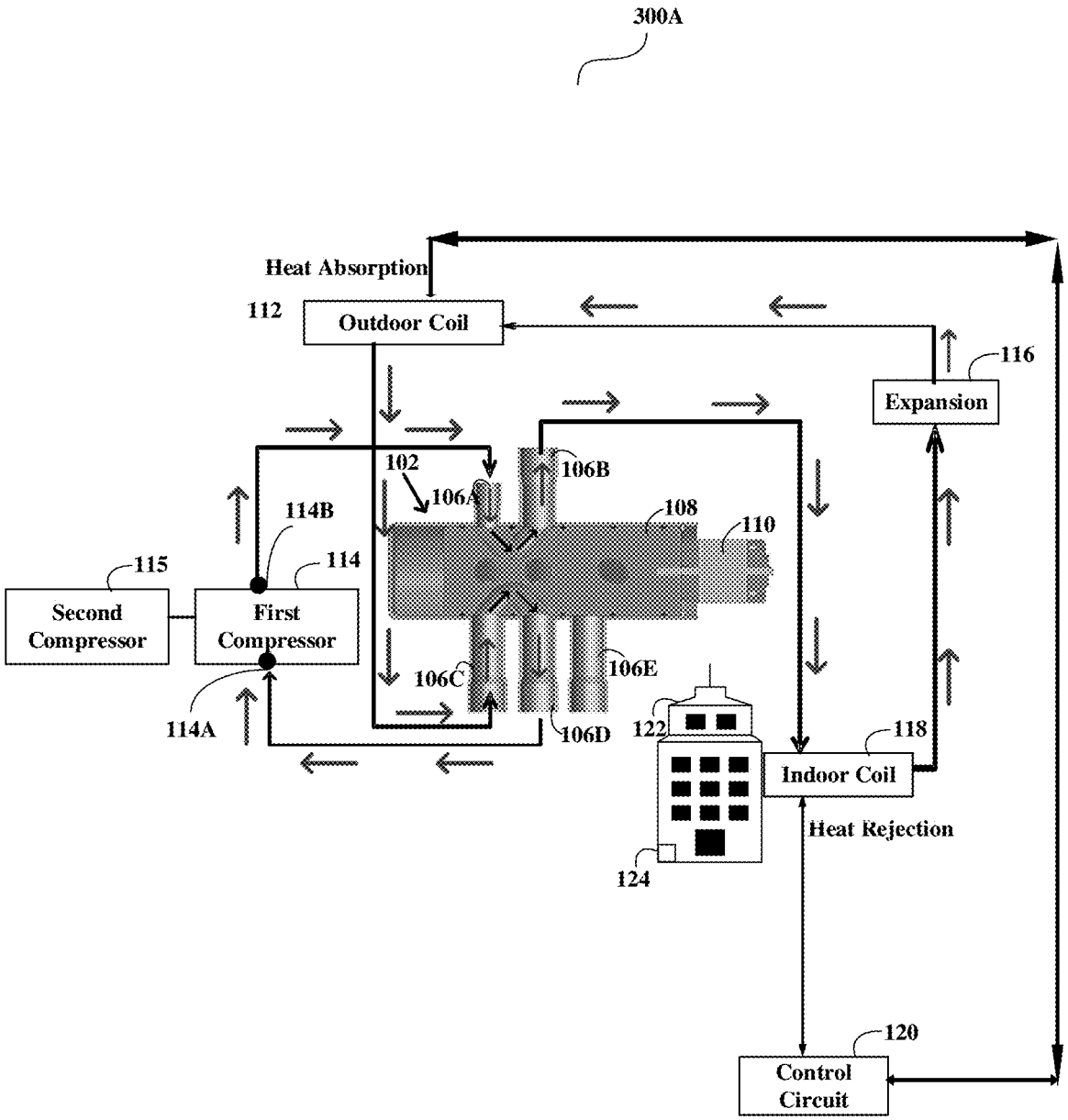
FIG. 3A depicts an exemplary reversing valve operating in a third position in a second mode according to an exemplary embodiment of the invention.

FIG. 3A depicts an exemplary reversing valve operating in a third position in a second mode according to an exemplary embodiment of the invention. As explained above in FIG. 2A, a user may select an option in a thermostat 124 to operate the reversing valve 102 in a second mode i.e. heating mode. When the user selects the option to operate the reversing valve 102 in the second mode, the thermostat 124 may transmit a command to a control board 120.

When the control board 120 receives the command from the thermostat 124 to operate the reversing valve 102 in the second mode, the control board 120 may determine an appropriate position for operating the reversing valve 102 to control the flow of refrigerant in the reversing valve 102. For this, the appropriate position is determined by the control board 120 based on air temperature outside the building/home 122. In an exemplary embodiment, the position may correspond to a third position in the second mode.

The control board 120 may determine the third position when the current air temperature outside the building/home 122 varies between the first temperature threshold and a fourth temperature threshold. In an exemplary embodiment, the first temperature threshold may be 65° Fahrenheit and the fourth temperature threshold may be 35° Fahrenheit. When the current air temperature outside the building/home 122 varies between the first temperature threshold and the fourth temperature threshold, the control board 120 may determine the third position for the second mode. In an exemplary embodiment, the third position of the reversing valve 102 may refer to a position when the reversing valve 102 operates at partial load (i.e. 1 ton to 2.5 tons) for heating requirements.

Then, the control board 120 may communicate the command and the determined third position to the stepper motor 110 for operating the reversing valve 102 in the second mode. The stepper motor 110 may translate and/or rotate the piston 108 based on the command and the determined third position.

In an exemplary embodiment of the invention, the different positions of the piston may be changed as provided in table below.

TABLE 1

| | | To Position | | | |
|---|---|---|---|---|---|
| | Position | 1 | 2 | 3 | 4 |
| From Position | 1 | N/A | A = 0°; L = −28.6 mm | A = 60°; L = 0 mm | A = −60°: L = 0 mm |
| | 2 | A = 0°; L = 28.6 mm | N/A | A = 60°; L = 28.6 mm | A = −60°; L = 28.6 mm |
| | 3 | A = −60°; L = 0 mm | A = −60°; L = −28.6 mm | N/A | A = −120°; L = 0 mm |
| | 4 | A = 60°; L = 0 mm | A = 60°; L = −28.6 mm | A = 120°; L = 0 mm | N/A |

As shown in the table, when the piston moves from the first position to the second position, the stepper motor is not rotated, but there is only a translational motion of the piston from right to left (−) by 28.6 mm. Similarly if the piston is in the second position, the control board may determine that piston is moved from left to right by 28.6 mm and no rotation is required.

If the piston is at first position and require to move to third position as determined by the control board, the piston is rotated by 60 degrees but no translational motion of the piston is required. Similarly, while changing from third position to first position, the stepper motor is rotated anti-clockwise by 60 degrees, but no translational motion of the piston is required.

Like wise movement from first position of the piston to the fourth position of the piston, there is no translational motion. Only the piston is rotated anti-clockwise by 60 degrees.

Thus, the various positions of the piston are controlled by providing rotational and/or translational motion to the piston by the stepper motor as described above in Table 1.

It is noted that the values provided herein are exemplary and for understanding. The actual values of the rotational and translational motion of the piston may depend upon the design and configuration of the reversing valve as well as the type of stepper motor. The various values for different positions are within the scope of the invention.

Furthermore, as depicted in FIG. 3A, the first tube 106A may be connected to a discharge/outlet port of a first compressor 114. The second tube 106B may be connected to an indoor coil 118 and the third tube 106C may be connected to an outdoor coil 112. And, the fourth tube 106D may be connected to a return/inlet port 114A of the first compressor 114 and the fifth tube 106E is not connected to any components as shown.

Moreover, as depicted in FIG. 3A in the third position and in the second mode of the reversing valve 102, the refrigerant may flow from the discharge/outlet port of the first compressor 114 to the first tube 106A and from the first tube 106A to the second tube 106B. Then, from the second tube 106B to the indoor coil 118, from the indoor coil 118 to the outdoor coil 112 through an expansion 116, and from the outdoor coil 112 to the third tube 106C. From the third tube 106C to the fourth tube 106D, from the fourth tube 106D to the return/inlet port 114A of the first compressor 114 in the second mode. Thus, the first tube 106A connects with the second tube 106B and the third tube 106C connects with the fourth tube 106D when the reversing valve 102 operates in the third position and in the second mode. Thereby, in the third position and in the second mode, the first compressor 114 (i.e. rotary compressor) is only utilized for heating requirements at part load (i.e. 1 ton to 2.5 tons) Furthermore, the second compressor 115 is not utilized for the cooling requirements.

Figure 3B:
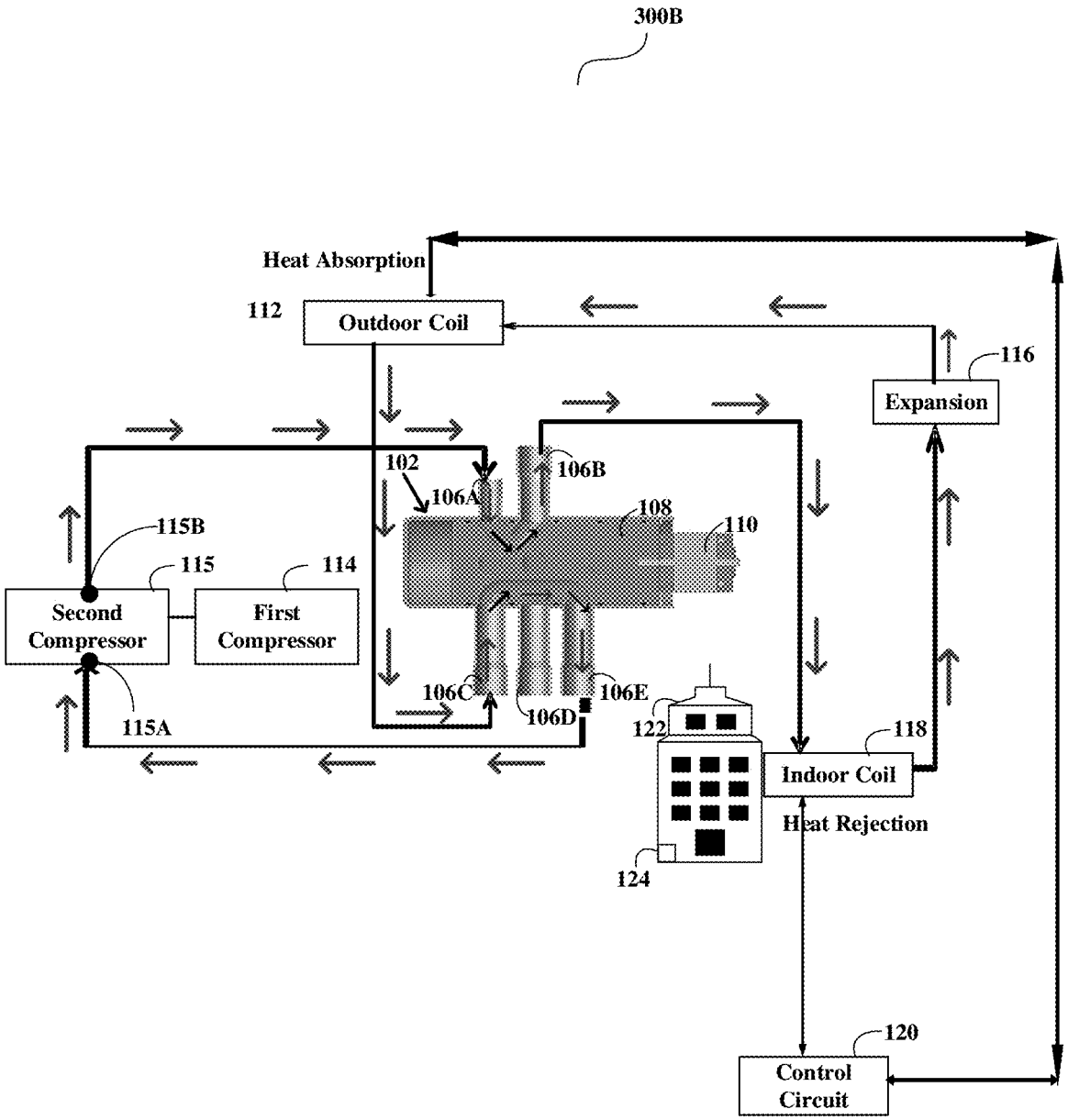
FIG. 3B depicts an exemplary reversing valve operating in a fourth position in a second mode according to an exemplary embodiment of the invention.

FIG. 3B depicts an exemplary reversing valve operating in a fourth position in a second mode according to an exemplary embodiment of the invention. As explained above in FIG. 2A, a user may select an option in a thermostat 124 to operate the reversing valve 102 in a second mode i.e. heating mode. When the user selects the option to operate the reversing valve 102 in the second mode, the thermostat 124 may transmit a command to a control board 120.

When the control board 120 receives the command from the thermostat 124 to operate the reversing valve 102 in the second mode, the control board 120 may determine an appropriate position for operating the reversing valve 102 to control the flow of refrigerant in the reversing valve 102. For this, the appropriate position is determined by the control board 120 based on air temperature outside the building/home 122 and/or a temperature defined by the user in the thermostat 124 as per embodiments explained in FIG. 2A above. In an exemplary embodiment, the position may correspond to a fourth position in the second mode.

The fourth position may be determined when the current air temperature outside the building/home 122 varies between the fourth temperature threshold and a fifth temperature threshold. In an exemplary embodiment, the fourth temperature threshold may be 35° Fahrenheit and the fifth temperature threshold may be 0° Fahrenheit and below. When the current air temperature outside the building/home 122 varies between the fourth temperature threshold and the fifth temperature threshold, the control board 120 may determine the fourth position for the second mode. In an exemplary embodiment, the fourth position of the reversing valve 102 may refer to a position when the reversing valve 102 operates at full load (i.e. 3 tons to 5 tons) for the heating requirements.

Then, the control board 120 may communicate the command and the determined fourth position to the stepper motor 110 for operating the reversing valve 102 in the second mode. The stepper motor 110 may translate and/or rotate the piston 108 based on the command and the determined fourth position.

Furthermore, as depicted in FIG. 3B, the first tube 106A may be connected to a discharge/outlet port 115B of a second compressor 115. The second tube 106B may be connected to an indoor coil 118 and the third tube 106C may be connected to an outdoor coil 112. And, the fifth tube 106E may be connected to a return/inlet port 115A of the second compressor 115 and the fourth tube 106D is not connected to any components as shown.

Moreover, as depicted in FIG. 3B in the fourth position and in the second mode of the reversing valve 102, the refrigerant may flow from the discharge/outlet port 115B of the second compressor 115 to the first tube 106A and from the first tube 106A to the second tube 106B. Then, from the second tube 106B to the indoor coil 118, from the indoor coil 118 to the outdoor coil 112 through an expansion 116, and from the outdoor coil 112 to the third tube 106C. From the third tube 106C to the fifth tube 106E, from the fifth tube 106E to the return/inlet port 115A of the second compressor 115 in the fourth mode. Thus, the first tube 106A connects with the second tube 106B and the third tube 106C connects with the fifth tube 106E when the reversing valve 102 operates in the fourth position and in the second mode. In this embodiment, the second compressor 115 is utilized to provide heating requirements at full load (i.e. 3 ton to 5 tons).

Although a limited number of positions (i.e. 4 positions) have been explained herein in the specification for the cooling mode or in the heating mode, however, any number and any other possible variations/alterations in the positions are within the scope of this invention. It may be noted herein that the values of the first temperature threshold, the second temperature threshold, third temperature threshold, fourth temperature threshold, and fifth temperature threshold may vary from case-to-case basis and may be decided by a manufacturer of the reversing valve 102 based on a region/area in a country for using the reversing valve 102. It is to be noted that the temperature threshold ranges provided herein are exemplary and any other possible variations/alterations in the temperature threshold ranges as well as the defined temperature threshold are within the scope of this invention. Further, instead receiving input regarding the temperature, the control board may automatically receive the outside air temperature. Similarly, the control board may receive the number of occupants in a given area using sensors/detectors.

In an exemplary embodiment the first compressor may be a rotary compressor. The rotary compressor is more energy efficient for large temperature ranges. The second compressor may be a scroll compressor. The Scroll compressor is more energy efficient at specific design load. Further, using different compressors provides high system efficiency at both full-load and part-load. The different cooling loads and heating loads are customized as per different geographical locations and loads. Through load matching and stepped capacity, the system offers a variety of options to improve comfort levels.

The stepper motor 110 and/or the control board 120 may determine an error associated with the position of the piston 108. For this, the stepper motor 110 and/or the control board 120 may determine an incorrect position of the piston 108 based on a current location (or co-ordinates) of the piston 108 on the holes. Further, the stepper motor 110 may communicate the incorrect position of the piston 108 to the control board 120. The control board 120 may verify the incorrect position of the piston 108 by comparing the incorrect position to a programmed location of the piston 108. In an exemplary embodiment, the programmed location of the piston 108 is already preprogrammed or configured in the control board 120. Accordingly, the control board 120 may provide a command to the stepper motor 110 to translate and/or rotate the piston 108 to a desired location based on the comparison. This would help in error correction of the position of the piston 108 with respect to the programmed location of the piston 108. Moreover, the logs of error correction and position of the piston 108 with respect to the programmed location may be captured/stored by the control board 120 for error control and diagnostics purpose.

Figure 4:
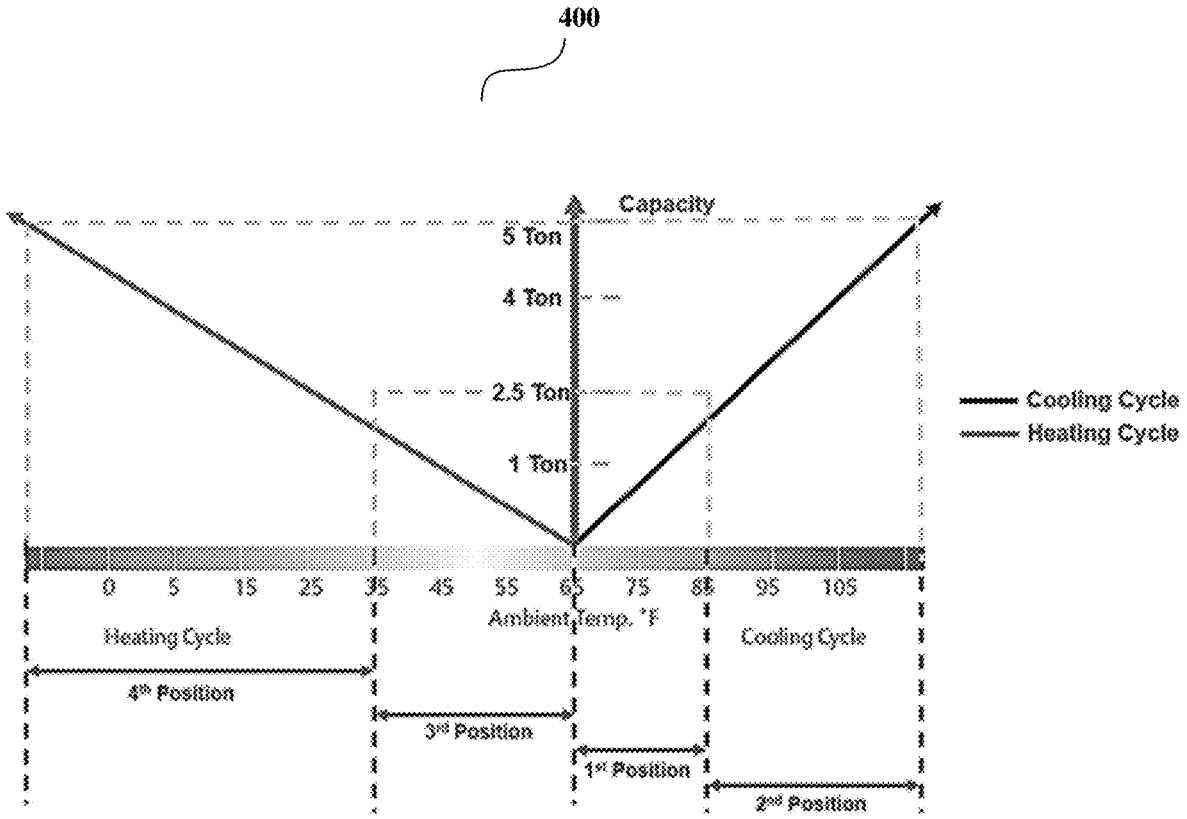
FIG. 4 depicts an exemplary graph illustrating different positions with respect to modes according to an exemplary embodiment of the invention.

FIG. 4 depicts an exemplary graph 400 illustrating different positions with respect to modes according to an exemplary embodiment of the invention. The graph 400 shows a first temperature threshold (65° Fahrenheit) and a second temperature threshold (85° Fahrenheit) for the first position in a first/cooling mode as discussed in FIG. 2A above. Also, shown is the second temperature threshold (85° Fahrenheit) and a third temperature threshold (105° Fahrenheit and above) for the second position in the first/cooling mode as discussed in FIG. 2B above. Further, the first temperature threshold (65° Fahrenheit) and the fourth temperature threshold (35° Fahrenheit) is shown for the third position in the second/heating mode as discussed in FIG. 3A above. And, the fourth temperature threshold (35° Fahrenheit) and a fifth temperature threshold (0° Fahrenheit and below) is depicted for the fourth position in the second/heating mode as discussed in FIG. 3B above.

Figure 5:
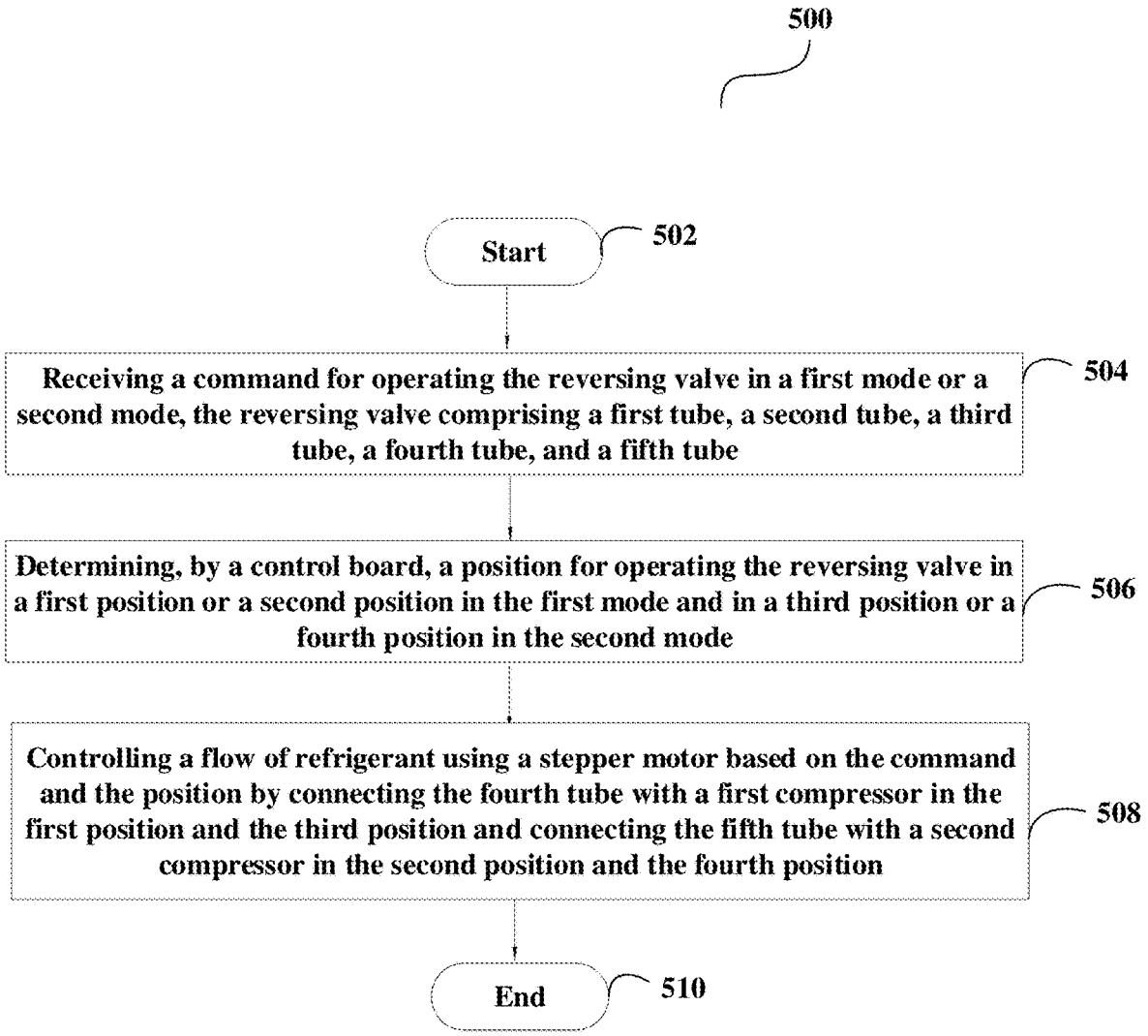
FIG. 5 depicts an exemplary flowchart illustrating a method to perform the invention according to an exemplary embodiment of the invention.

FIG. 5 depicts a flowchart outlining the features of the invention in an exemplary embodiment of the invention. The method flowchart 500 describes a method for controlling a flow of refrigerant in a reversing valve of an HVAC system. The method flowchart 500 starts at step 502.

At step 504, a control board 120 of a system 200A/200B or a system 300A/300B may receive a command for operating a reversing valve 102 in a first mode or a second mode. The reversing valve 102 comprises a first tube 106A, a second tube 106B, a third tube 106C, a fourth tube 106D, and a fifth tube 106E. The first mode may correspond to a cooling mode and the second mode may correspond to a heating mode. This has been explained in greater details in FIGS. 2A, 2B, 3A and 3B.

At step 506, the control board 120 of the system 200A/200B or the system 300A/300B may determine a position for operating the reversing valve 102 in a first position or a second position in the first mode and in a third position or a fourth position in the second mode. This has been explained in greater details in FIGS. 2A, 2B, 3A and 3B.

At step 508, the control board 120 of the system 200A/200B or the system 300A/300B may control a flow of refrigerant using a stepper motor 110 based on the command and the position by connecting the fourth tube 106D with a first compressor 114 in the first position and the third position and connecting the fifth tube 106E with a second compressor 115 in the second position and the fourth position. This has been explained in greater details in FIGS. 2A, 2B, 3A and 3B. Then, the method flowchart 500 may end at 510.

The present invention is applicable to various fields such as, but not limited to, residential homes, hospitality industry, museums, libraries, colleges, universities, hospitals, offices and any such building that is well known in the art and where the heat pump/s having the reversing valve is used.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C".

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A system comprising:

a reversing valve adapted to operate in a first mode or a second mode, the reversing valve comprising a first tube, a second tube, a third tube, a fourth tube, and a fifth tube;

a control board adapted to receive a command and determine a position for operating the reversing valve in the first mode or the second mode, wherein the reversing valve is operated in a first position or a second position in the first mode, wherein the reversing valve is operated in a third position or a fourth position in the second mode; and a stepper motor adapted to control a flow of refrigerant based on the command and the position by connecting the fourth tube with a first compressor in the first position and the third position and connecting the fifth tube with a second compressor in the second position and the fourth position.

2. The system of claim 1, wherein the first compressor and the second compressor perform a dual compressor modulation adapted to operate in part load or a full load in the first or the second mode.

3. The system of claim 1, wherein the first compressor is a rotary compressor and the second compressor is a scroll compressor.

4. The system of claim 1, wherein the first mode corresponds to a cooling mode and the second mode corresponds to a heating mode.

5. The system of claim 1, wherein the first tube connects with the third tube and the second tube connects with the fourth tube when the reversing valve operates in the first position and in the first mode.

6. The system of claim 1, wherein the first tube connects with the third tube and the second tube connects with the fifth tube when the reversing valve operates in the second position and in the first mode.

7. The system of claim 1, wherein the first tube connects with the second tube and the third tube connects with the fourth tube when the reversing valve operates in the third position and in the second mode.

8. The system of claim 1, wherein the first tube connects with the second tube and the third tube connects with the fifth tube when the reversing valve operates in the fourth position and in the second mode.

9. The system of claim 1, wherein in the first position the refrigerant flows from the first compressor to the first tube, from the first tube to the third tube, from the third tube to an outdoor coil, from the outdoor coil to an indoor coil, from the indoor coil to the second tube, from the second tube to the fourth tube and from the fourth tube to the first compressor.

10. The system of claim 1, wherein in the second position the refrigerant flows in from the second compressor to the first tube, from the first tube to the third tube, from the third tube to an outdoor coil, from the outdoor coil to an indoor coil, from the indoor coil to the second tube, from the second tube to the fifth tube and from the fifth tube to the second compressor.

11. The system of claim 1, wherein in the third position the refrigerant flows from the first compressor to the first tube, from the first tube to the second tube, from the second tube to an indoor coil, from the indoor coil to an outdoor coil, from the outdoor coil to the third tube, from the third tube to the fourth tube and from the fourth tube to the first compressor.

12. The system of claim 1, wherein in the fourth position the refrigerant flows from the second compressor to the first tube, from the first tube to the second tube, from the second tube to an indoor coil, from the indoor coil to an outdoor coil, from the outdoor coil to the third tube, from the third tube to the fifth tube and from the fifth tube to the second compressor.

13. The system of claim 1, wherein a piston is translated and/or rotated by the stepper motor, wherein the piston is coupled with the reversing valve to control the flow of refrigerant based on a required load.

14. The system of claim 1, wherein the command is provided for operating the reversing valve based on an outside air temperature.

15. A method comprising:

receiving a command for operating the reversing valve in a first mode or a second mode, the reversing valve comprising a first tube, a second tube, a third tube, a fourth tube, and a fifth tube;

determining, by a control board, a position for operating the reversing valve in a first position or a second position in the first mode and in a third position or a fourth position in the second mode; and controlling a flow of refrigerant using a stepper motor based on the command and the position by connecting the fourth tube with a first compressor in the first position and the third position and connecting the fifth tube with a second compressor in the second position and the fourth position.

16. The method of claim 15, wherein the first compressor and the second compressor perform a dual compressor modulation adapted to operate in part load or a full load in the first or the second mode.

17. The method of claim 15, wherein the first compressor is a rotary compressor and the second compressor is a scroll compressor.

18. The method of claim 15, wherein the first mode corresponds to a cooling mode and the second mode corresponds to a heating mode.

19. The method of claim 15, wherein the first tube connects with the third tube and the second tube connects with the fourth tube when the reversing valve operates in the first position and in the first mode.

20. The method of claim 15, wherein the first tube connects with the third tube and the second tube connects with the fifth tube when the reversing valve operates in the second position and in the first mode.

21. The method of claim 15, wherein the first tube connects with the second tube and the third tube connects with the fourth tube when the reversing valve operates in the third position and in the second mode.

22. The method of claim 15, wherein the first tube connects with the second tube and the third tube connects with the fifth tube when the reversing valve operates in the fourth position and in the second mode.

* * * * *